US008339260B2

(12) United States Patent
Krieger et al.

(10) Patent No.: US 8,339,260 B2
(45) Date of Patent: Dec. 25, 2012

(54) SECURING A HAZARDOUS AREA IN THE REGIN SURROUNDING THE AUTOMATIC LOADING OF REELS ON A REEL CHANGER

(75) Inventors: Katja Paula Krieger, Zellingen (DE); Manfred Wilhelm Maierhöfer, Volkach (DE); Klaus Karl Müller, Trennfeld (DE); Josef Herbert Olbort, Mainbernheim (DE); Karlheinz Rahner, Prosselsheim (DE); Senad Ugljesa, Eisingen (DE)

(73) Assignee: Koenig & Bauer Aktiengesellschaft, Wurzburg (DE)

( * ) Notice: Subject to any disclaimer, the term of this patent is extended or adjusted under 35 U.S.C. 154(b) by 0 days.

(21) Appl. No.: 12/998,378

(22) PCT Filed: Jul. 28, 2009

(86) PCT No.: PCT/EP2009/059698

§ 371 (c)(1), (2), (4) Date: Apr. 14, 2011

(87) PCT Pub. No.: WO2010/043430

PCT Pub. Date: Apr. 22, 2010

(65) Prior Publication Data

US 2011/0202161 A1 Aug. 18, 2011

(30) Foreign Application Priority Data

Oct. 14, 2008 (DE) ..... 10 2008 042 813

(51) Int. Cl.

| | |
|---|---|
| ***G08B 13/00*** | (2006.01) |
| ***G08B 13/18*** | (2006.01) |
| ***G08B 23/00*** | (2006.01) |
| ***G05B 9/02*** | (2006.01) |
| ***G05B 19/04*** | (2006.01) |
| ***G06F 19/00*** | (2011.01) |
| ***H01J 3/14*** | (2006.01) |

(52) U.S. Cl. ..... 340/541; 340/556; 340/565; 340/573.1; 700/79; 700/108; 700/112; 700/255; 250/216

(58) Field of Classification Search ..... 340/541, 340/553, 555, 556, 565, 572.3, 572.4, 573.1; 250/216, 221; 700/79, 80, 108, 112, 255
See application file for complete search history.

(56) References Cited

U.S. PATENT DOCUMENTS 4,794,248 A * 12/1988 Gray ..... 250/221

(Continued)

FOREIGN PATENT DOCUMENTS

DE 31 34 815 C2 3/1983

(Continued)

*Primary Examiner* — John R. Cottingham
*Assistant Examiner* — Darrin Dunn
(74) *Attorney, Agent, or Firm* — Mattingly & Malur, P.C.

(57) ABSTRACT

A hazardous area in the region surrounding a reel transport of a reel changer is secured. A contactless protective device is located at the access boundaries of the region. This protective device can be deactivated for feeding and/or removing a known object and comprises an evaluation unit. The protective device is configured as a light curtain that is comprised of a plurality of light beams that run in parallel to each other. The evaluation unit includes an assembly for detecting the sequence of the interruption of the light beams during the feeding and/or the removal of an object. Based on the detected sequence of interruption of the light beams, a known object, that is permitted to access the hazardous area, is detected. The protective device is deactivated in this situation. Securing the hazardous area further includes the provision of a second contactless protective device that is permanently active.

28 Claims, 3 Drawing Sheets

U.S. PATENT DOCUMENTS

| | | | | |
|---|---|---|---|---|
| 5,243,183 | A | 9/1993 | Barron, Jr. et al. | |
| 5,508,511 | A * | 4/1996 | Zur et al. | 250/222.1 |
| 5,833,167 | A * | 11/1998 | Thuer et al. | 242/559 |
| 6,007,017 | A | 12/1999 | Vorwerk | |
| 6,288,644 | B1 * | 9/2001 | Mathews et al. | 340/555 |
| 6,979,814 | B2 | 12/2005 | Kudo et al. | |
| 7,619,517 | B2 * | 11/2009 | Tracy | 340/556 |
| 7,767,954 | B2 * | 8/2010 | Pirkl | 250/221 |
| 7,805,209 | B2 * | 9/2010 | Bechtel et al. | 700/79 |
| 7,821,394 | B2 * | 10/2010 | Fukumura | 340/556 |
| 7,950,602 | B2 * | 5/2011 | Petri | 242/559 |
| 2002/0017603 | A1 * | 2/2002 | Haberer et al. | 250/221 |
| 2002/0070860 | A1 | 6/2002 | Wuestefeld et al. | |
| 2003/0146373 | A1 * | 8/2003 | Kudo et al. | 250/221 |
| 2003/0218122 | A1 * | 11/2003 | Haberer et al. | 250/221 |
| 2006/0067089 | A1 * | 3/2006 | Hocquard et al. | 362/576 |
| 2007/0069114 | A1 * | 3/2007 | Clifton et al. | 250/221 |
| 2007/0170298 | A1 | 7/2007 | Lehrieder et al. | |
| 2008/0055081 | A1 * | 3/2008 | Lea | 340/555 |
| 2009/0129784 | A1 * | 5/2009 | Carnicelli et al. | 398/154 |
| 2010/0127158 | A1 * | 5/2010 | Scheiber et al. | 250/208.1 |

FOREIGN PATENT DOCUMENTS

| | | | |
|---|---|---|---|
| DE | 295 00 873.3 | U1 | 4/1995 |
| DE | 296 02 098 | U1 | 3/1996 |
| DE | 199 38 639 | A1 | 2/2001 |
| DE | 199 38 639 | B4 | 2/2001 |
| DE | 100 26 305 | A1 | 11/2001 |
| DE | 10 2004 038 906 | A1 | 3/2006 |
| DE | 10 2005 030 829 | A1 | 1/2007 |
| DE | 10 2005 048 466 | A1 | 4/2007 |
| DE | 10 2006 053 002 | A1 | 5/2008 |
| EP | 0 849 201 | A1 | 6/1998 |
| EP | 1 331 433 | A2 | 7/2003 |
| EP | 1 593 630 | A2 | 11/2005 |
| EP | 1 835 310 | A2 | 9/2007 |
| JP | 2007-235408 | A | 9/2007 |
| WO | 2005/080241 | A2 | 9/2005 |

* cited by examiner

SECURING A HAZARDOUS AREA IN THE REGIN SURROUNDING THE AUTOMATIC LOADING OF REELS ON A REEL CHANGER

CROSS-REFERENCES TO RELATED APPLICATIONS

This application is the U.S. national phase, under 35 U.S.C. 371, of PCT/EP2009/059698, filed Jul. 28, 2009; published as WO 2010/043340 A1 on Apr. 22, 2010, and claiming priority to DE 10 2008 042 813.2, filed Oct. 14, 2008, the disclosures of which are expressly incorporated herein by reference.

FIELD OF THE INVENTION

The invention relates to a system for securing a hazardous area in the region surrounding the automatic loading of reels on a reel changer. A contactless safety device is placed at access boundaries of the region. This safety device can be deactivated to allow a known object to pass in or out of the hazardous area in the region surrounding the automatic loading of the reels on a reel changer. The safety device includes an evaluation unit and is embodied as a light beam barrier which has multiple light beams passing parallel to one another.

BACKGROUND OF THE INVENTION

Technical systems, such as machine tools and industrial robots, for example, harbor the risk of injury to persons approaching the movable parts of the machine. Hazardous areas around a reel changer include particularly the pivoting region of the reel support arms, the area behind the reel changer in the pivoting region of the splicing frame, the loading area, and the pit below the reel changer, if provided. It is therefore necessary for machines to be provided with safety devices, which prevent injuries to persons caused by the working movement of the movable parts of the machine. In the past, primarily mechanical safety devices have been employed for this purpose. For instance, machine tools are frequently completely enclosed, with access being allowed via safety gates. Industrial robots are operated in areas enclosed by protective fencing.

However, mechanical safety devices are associated with disadvantages. Adequate space must be provided for the safety device itself and for the opening of any safety gates that may be present, which increases the amount of space needed for the entire system. Moreover, rapid intervention into the production sequence is not possible, as opening safety gates or protective fencing requires a corresponding amount of time and control. Furthermore, mechanical safety devices are not maintenance and wear free.

DE 10 2005 048 466 A1 describes a personnel safety device on a reel changer of a printing press, which is embodied, for example, in the form of a catch net on the loading side of the reel changer. This safety device is embodied to turn the loading side into a secured area whenever the residual paper reel approaches a critical diameter, i.e., is at risk of breaking. Persons near the reel changer are thereby to be reliably protected from fragments of bursting reels. For this purpose, the safety device is mounted on the transfer table that is used to supply new reels of material, and at a fixed point in relation to the reel stand on the loading side. To supply a new material reel, the transfer table moves up to the reel stand, thereby setting up the safety device. Therefore, the safety device is activated only when the described critical status of the residual paper reel is reached. At all other times, the area on the loading side of the reel changer can be accessed unimpeded. However, to inform persons present in the potentially hazardous area of the potential hazard even when the mechanical safety device is inactive, an additional securing of the area using photoelectric beam interruption detectors is proposed. On the basis of the signal emitted by the beam interruption detector, a visible or audible signal for a person present in the area of the reel changer is emitted.

From WO 2005/080241 A2 it is known to provide a zone safety device in the area surrounding large moved reels of material for purposes of occupational safety. In this case, the erection of fencing along the boundaries of a material reel storage area is proposed. To allow material reels to be transported into and out of the storage area, a lock can be provided in the zone safety device. In the lock area, a preferably contactless zone safety device is proposed, which can be implemented as photoelectric beam interruption detectors or ultrasonic sensors, for example. By arranging sensors of this type at different levels, complex sensing routines can be implemented, so that, for example, reels of material are allowed to pass through the lock without problems, whereas any unauthorized passage through the sensor areas will trigger an alarm and/or will halt the movement of the material reels, in order to prevent accidents.

EP 08 49 201 A1 relates to a method for detecting lateral position and for positioning a reserve web reel, wherein reel thickness and the respective lateral distance from the reel changer are measured and evaluated by directly opposite scanning elements in the form of sensors, for example, laser beam or ultrasonic sensors. Moreover, the scanning elements are connected to a programmable control system for a drive unit for positioning the spare web reel.

EP 15 93 630 A2 discloses a device for preparing a web of material wound onto a spare reel, which has a bearing for supporting and rotating the spare reel about a longitudinal axis. Sensors detect the radius of the spare reel during rotational movement. A plurality of sensors for detecting the radius are arranged parallel to the longitudinal axis of the spare reel.

The contactless devices described in the aforementioned publications serve to detect the positioning or the dimensions of a reel in the region surrounding the automatic loading of reels on a reel changer, and serve no safety or protective function.

From DE 31 34 815 C2, a contactless area safety system, for example, for securing or monitoring viewing windows is known. The area safety system has a source which emits radiation over its entire length, along one side of the area to be secured. Along the opposite side, a reflective strip is provided. The radiation is predominantly reflected in the plane spanned by the source and the reflective strip. At each end of the radiation source, a radiation detector is provided, which is connected to an evaluation circuit. This area safety system can be used as security against passage, for example, through hazardous areas by installing a multiple infrared beam barrier between two rods, which, when interrupted, triggers a signal. The disadvantage of this system for securing hazardous areas is that it is able to perform only a simple protective function.

From DE 199 38 639 B4, a device for securing a hazardous area, particularly the hazardous area of an automatically operating machine, is known, said device comprising first means for generating an optically monitored virtual barrier and second means for generating a switching command to stop the machine when a barrier is penetrated. The first means has an image recording unit and a defined target, the image of which is recorded by the image recording unit and compared by a comparison unit (second means) with a size which is characteristic for a reference image. The defined target is a structured, high-contrast pattern, which contains positioning marks for determining a current position. Using a point pattern, according to one embodiment example of the device, a virtual barrier can be generated, the shape of which corresponds approximately to that of a beam interruption detector. Alternatively, however, a plurality of point patterns can be placed in a row to generate a linear pattern. This device performs only a protective function. The evaluation and the comparison of the recorded images with the reference image are costly.

DE 296 02 098 U1 relates to a reel changer in a web-fed rotary printing press for loading a web of print substrate wound onto reels into a printing couple of the web-fed rotary printing press. The area surrounding the reel changer is monitored by at least one sensor, particularly an optical sensor, for example, a camera, which is connected to an image recognition computer. In the image recognition computer, a comparison is made between a recorded actual image of the area and a stored set image or a sequence of set images. In the event of deviations, a signal generating device generates a warning or alarm signal. The at least one sensor can also be assigned contact mats, contact strips, photoelectric beam interruption detectors, or similar contactless safety devices, which supply partial information or control or activate the sensor. The solution disclosed in this publication enables a monitoring of the region surrounding the reel changer, whereby selective protection is realized in that known objects are recognized and the entry thereof into the area without triggering warning or alarm signals is enabled. However, image recognition can be easily influenced by subjective factors in the monitored area, for example, a deviation in position of an object, which is to be recognized as known in the set image, on a recorded actual image, which can lead to disruptions or malfunctions.

DE 100 26 305 A1 describes an optoelectronic device for monitoring a protected area with at least one contactless safety device, which has an evaluation unit for generating an object detection signal when an object enters the protected area. The contactless safety device can be a light beam barrier, which comprises a transmitter unit which transmits light beams, a receiver unit which receives the light beams, and an evaluation unit connected to the receiver unit. To perform another function in addition to the protective function, the contactless safety device is coupled with an image recording unit for sensing a secondary monitoring area, which lies close to the protected area but outside of the protected area. This so-called muting function allows the short-term deactivation of the contactless safety device, to allow recognized objects to enter the protected area without generating an object detection signal. The muting function is implemented by the image recording unit, which detects the objects that enter the secondary monitoring area, wherein differentiation is made between permissible and impermissible objects. The detected objects may be classified. The disadvantage of this solution is that the recognition of known objects does not always function reliably. In addition, the setup of an additional image recording unit involves additional complexity and financial expense.

From DE 10 2005 030 829 A1 a method for operating a multiple infrared beam barrier is known, in which a switching signal is generated from the sequential interruption of the light beams with a stored reference profile.

DE 10 2004 038 906 A1 proposes transmitting a mark on an object to an evaluation unit, in addition to a multiple infrared beam barrier.

In DE 295 00 873 U1 the sequence of interruption of the light beams of a multiple infrared beam barrier is detected, in order to distinguish between permissible objects and persons, for example.

SUMMARY OF THE INVENTION

The problem addressed by the invention is that of devising a system for securing a hazardous area in the region surrounding the automatic loading of reels onto a reel changer.

The problem is solved according to the invention by the provision of the evaluation unit of the safety device with the ability to detect a sequence in the interruption of the light beams when an object passes into or out of the region being protected. On the basis of this detection sequence, the evaluation unit determines if the object is one that is known. If it is a known object, it is allowed access to the hazardous area. In this case, the evaluation unit deactivates the safety device. The system for securing the hazardous area also includes a second contactless safety device which is permanently active.

The advantages to be achieved by the invention consist particularly in that an improved system for securing hazardous areas is provided on the basis of contactless safety mechanisms for the region surrounding the automatic loading of reels onto a reel changer, which ensures a continuous securing of the protected area even in the case of different reel diameters and during the removal of residual cores.

The system for securing hazardous areas has a contactless safety device, which is connected to an evaluation unit. The safety device is embodied as a light beam barrier, which has multiple beams of light that run parallel to one another. The evaluation unit detects the sequence in which the light beams are interrupted when an object is introduced and/or removed, and on the basis of said sequence can identify a known object, and in predefined cases can deactivate the safety device.

The advantages of the invention are particularly that the safety device, in addition to a protective function, also has a muting function, which saves the cost of setting up an additional device for performing the muting function.

A muting function ensures a temporally limited deactivation of parts of a safety device or of the entire safety device. Preferably, this allows objects access without actuating the safety device.

In one preferred embodiment, the beams of light are spaced evenly from one another and extend inclined toward horizontal, wherein in other embodiments the light beams can also be arranged running horizontally with the surface of the light beam barrier inclined toward vertical.

At least one light beam of the light beam barrier, passing above the known object, can advantageously be permanently active, in order to detect the entry of a person or an impermissible object into the secured region surrounding the automatic loading of reels onto a reel changer, even if said person and object enter the secured area accompanying the known object that is allowed access, while the safety device is deactivated.

The known object that is allowed access can be, for example, a material reel, a residual core or a driverless, automatic transport vehicle.

Irrespective of this, the system for securing a hazardous area can have at least two photoelectric cells, for example, reflective photoelectric cells, for muting, which are connected to the evaluation unit. More particularly, in one preferred embodiment, four reflective photoelectric cells are installed as a muting group (two in front of and two behind the light beam barrier). In this manner, objects, particularly residual cores, can be identified on the basis of a reflective strip glued to the side thereof, for example, and the muting function can be activated, or the safety device can be deactivated. This can be necessary particularly during the removal of residual cores, which have a different shape from reels. For example, if only reels are implemented as known objects in the evaluation unit (on the basis of shape and the simple evaluation of the sequence of interruption of the light beams), the muting function can be implemented on the basis of the reflective strip on the residual core. Residual cores are frequently removed using automatic transport vehicles (AGV=automatic guided vehicle). To allow said vehicles access to the secured area, they must also be provided with reflective strips for muting, or a corresponding sequence of interruption of the light beams of the light beam barrier must be known in the evaluation unit, in order to identify the AGV as a known object that is allowed access to the secured area.

To secure the protected area against the entry of persons or objects accompanying the known object while the safety device is deactivated, the system for securing the hazardous area can have a second, permanently active, contactless safety device comprising at least two light beams, which intersect a slight distance above the known object, with the continued path of said beams passing close to the known object. These two light beams thus extend only a few millimeters to a few centimeters, at parallel spacing, from imaginary tangents lying against the upper half of the known object. The lower ends of the two light beams are therefore located clearly below the upper edge of the known object, and can lie near the axial plane of the known object, depending upon the chosen angle of inclination.

One advantage of the invention consists in that the second, permanently active, contactless safety device allows a reliable, permanent securing of a hazardous area, even when the known object is a reel having a greater reel diameter. The path of the beam does not allow anything to unintentionally pass over or under the beams of the second safety device. In any case, a person can pass below the beams only in a severely bent position. However, even the best safety device can provide only limited protection against all eventualities or against intentional circumvention. It cannot be the job of such devices to reliably protect against malicious entry in every case.

A further advantage of the invention is that the safety device can be attached directly to the reel changer. Therefore, in contrast to previously known solutions, which require an attachment point above the reel, no additional attachment points external to the reel changer are required.

According to one particularly preferred embodiment, the contactless safety device and/or the second, permanently active, contactless safety device comprise one transmitter and one receiver for each light beam. However, embodiments are also possible in which the safety devices comprise precisely one transmitter, one receiver and a plurality of deflecting mirrors for all the light beams together.

In one advantageous embodiment, in the aforementioned safety devices one-way beam interruption detectors are used, in which transmitter and receiver are arranged opposite one another, in separate housings.

The use of reflective beam interruption detectors for the described safety devices has proven particularly expedient. In these embodiments, a combined transmitting and receiving unit is arranged opposite a reflector. The emitted light beams are reflected back to the receiver by the reflector.

It is also advantageous for the positions of the transmitter, receiver, reflector and/or deflecting mirror to be adjustable. In this manner, adjustment can be made to different objects, which are known and which are allowed access to the secured area. In this case, it has proven particularly favorable for the system for securing a hazardous area to be equipped with a sensor for detecting the dimensions of the known object.

Particularly for the proper functioning of the second, permanently active, contactless safety device, it must be ensured that the beams do not come in contact with the known object, since they are intended to secure the hazardous area during the introduction and/or removal of a known object while the first safety device is inactive. Accordingly, the second safety device cannot be triggered when the known object is passing through the access boundaries. The adjustability to different objects ensures that the beams always remain outside of the region through which the known object is passing.

In another further developed embodiment, it is advantageous for the sensor to be connected to an adjustment device. Said adjustment device is used for the automatic adjustment of the transmitter, receiver, reflector and/or deflecting mirror to the known object. Using an adjustment device of this type ensures that the transmitter, receiver, reflector and/or deflecting mirror is always repositioned on the basis of the detected dimensions of the known object. Naturally, it is also possible to perform positioning manually. For this purpose, it could be conceivable for a corresponding scale to be attached to the reel changer in order to facilitate manual positioning.

This system for securing a hazardous area has proven advantageous for a reel having a reel diameter of up to 1,524 mm. With reels of this size, adequate safety measures are no longer possible using conventional safety devices, since shorter persons bending only slightly are able to walk under the light beams of the second safety device.

The system for securing a hazardous area can also comprise a photoelectric cell, which is arranged inside the secured area for the purpose of positioning a reel or an automatic transport vehicle in a starting position.

BRIEF DESCRIPTION OF THE DRAWINGS

Embodiment examples of the invention are illustrated in the set of drawings and will be specified in greater detail in what follows.

The drawings show.

DESCRIPTION OF THE PREFERRED EMBODIMENT

Figure 1:
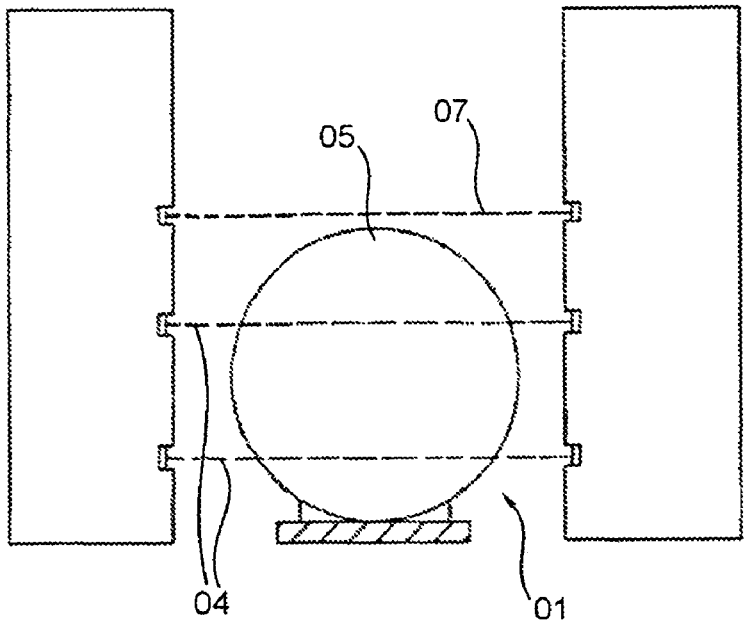
FIG. 1 an arrangement illustrating the principle of a system for securing a hazardous area in the region surrounding the automatic loading of reels.
Figure 2:
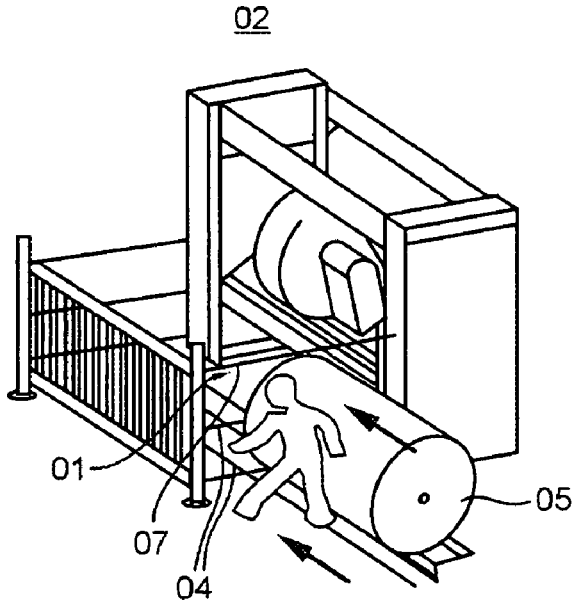
FIG. 2 a perspective illustration of a reel changer having a system for securing a hazardous area.

FIG. 1 shows a system for securing a hazardous area in the region 01 surrounding the automatic loading of reels onto a reel changer 02 (see FIG. 2). The system for securing a hazardous area comprises a first contactless safety device, located at the access boundaries. Access boundaries to be secured are located not only on the reel intake side, but also opposite the reel intake side, if both sides are freely accessible to persons. The first safety device comprises two light beams 04, which secure the region through which a reel 05 or a residual core can pass, wherein the first safety device can be deactivated to allow entry and exit. In what follows, when only a reel 05 to be introduced into the secured area is mentioned, this also applies similarly to a residual core or automatic transport vehicle to be introduced, and to the reverse sequence of movements executed when removing the reel 05 or the residual core or automatic transport vehicle.

For changing the reel 05, the first safety device can be deactivated. The system for securing a hazardous area further has a second, permanently active, contactless safety device for permanently securing the region surrounding the reel 05. The second safety device comprises a light beam 07, which is spaced a distance of 50 mm from the greatest reel diameter (maximum processable reel diameter). However, with larger reel diameters, a second safety device of a similar embodiment has proven disadvantageous.

Figures 3A, 3B, 3C:
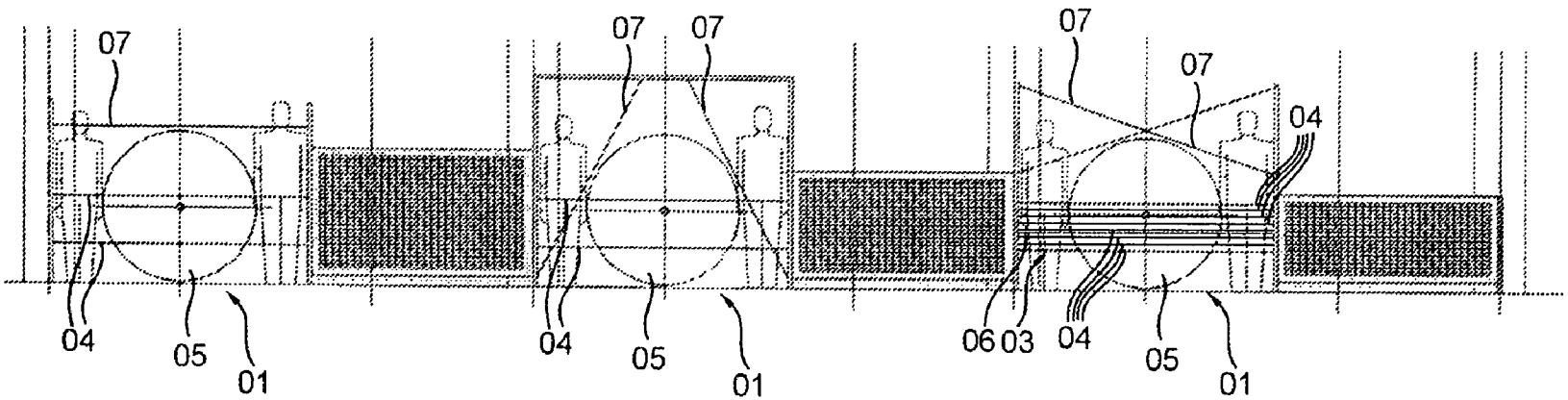
FIG. 3*a* an illustration of the principle of a system for securing a hazardous area in the region surrounding the automatic loading of reels.
FIG. 3*b* an illustration of the principle of a modified system for securing a hazardous area.
FIG. 3*c* a multiple beam barrier for a contactless safety device of a system for securing a hazardous area in the region surrounding the automatic loading of reels, with a second, permanently active, contactless safety device.

As is clear from FIG. 2 or 3*a*, the danger exists that a shorter person, accompanying the reel 05, could walk into the secured reel loading area, and could thereby be injured by the moving machine parts or the moved reel 05.

FIG. 3*b* shows a system for securing a hazardous area in the region 01 surrounding the automatic loading of reels. Here again, the system for securing a hazardous area comprises a first, contactless safety device at the access boundaries, having two light beams 04, which secure the region through which the reel 05 or the residual core or automatic transport vehicle can pass. To permanently secure the area surrounding the reel 05, a second, permanently active, contactless safety device is used. The second safety device comprises two light beams 07, beginning from points located above the reel 05 and running laterally past the reel 05, reaching the area near the floor. As is clear from FIG. 3*b*, a safety device embodied in this manner also cannot offer adequate protection. Because the light beams 07 travel past the reel 05, reaching almost to the floor, the danger exists that a person walking along next to the reel 05 during installation could step over the light beams 07.

FIG. 3*c* shows a system for securing a hazardous area in the region 01 surrounding the automatic loading of reels. In contrast to the known solutions, this system for securing a hazardous area has a light beam barrier 03 as a contactless safety device at the access boundaries of the secured region 01 surrounding the automatic loading of reels. The light beam barrier 03 can be deactivated to allow the reel 05 or residual core or automatic transport vehicle to be introduced or removed. In addition, a second, permanently active, contactless safety device is provided for permanently securing the region surrounding the reel 05, which will be described in greater detail below. At this point it should once again be mentioned that access boundaries to be secured can be located not only on the reel intake side, but also opposite the reel intake side. Safety devices are to be situated on both sides if both sides are freely accessible to persons. The contactless safety device, in combination with the evaluation unit, secures every access boundary to be secured using a light beam barrier 03.

In the embodiment example shown, the light beam barrier 03 is formed by multiple light beams 04 extending parallel to one another, which are uniformly spaced from one another by preferably 40 mm, and extend inclined toward horizontal. Of course, different spacing or different angles of inclination may also be chosen. The light beams 04 can also extend horizontally, and the surface of the light beam barrier can be arranged inclined toward vertical, with the angle of inclination preferably being 15°.

A transmitter and a receiver are assigned to the light beams 04 of the light beam barrier 03, and are positioned at the end points of the light beams 04. The light beam barrier 03 is connected to an evaluation unit, which is not illustrated here. The evaluation unit detects the sequence of interruption of the light beams 04 when a reel 05 or a residual core or an automatic transport vehicle is introduced and/or removed, and deactivates the system for securing the hazardous area comprising the light beam barrier 03 when a known object that is allowed access to the secured region is detected.

The evaluation unit evaluates whether the individual light beams 04 of the light beam barrier 03 are interrupted in sequence or are again uninterrupted. It is irrelevant how many individual light beams 04 are interrupted, or in what region they are interrupted.

Gaps in the interruption of the individual light beams 04 are not permissible, however.

Irrespective of this, the system for securing the hazardous area comprises four photoelectric cells 06 for muting, particularly reflective photoelectric cells 06, wherein two reflective photoelectric cells 06 are arranged in pairs in front of the light beam barrier 03 and two behind the light beam barrier. The cells serve to deactivate (mute) the light beam barrier 03 when a known object, particularly a residual core, is detected, the shape of which makes evaluating the sequence of interruption of the light beams more difficult. Moreover, the reflective photoelectric cells 06 are connected to an evaluation unit not shown here. For detection purposes, the residual cores are equipped with reflective strips, which are positioned on the residual cores in accordance with the arrangement of the reflective photoelectric cells 06. The light beam barrier 03 is muted (switched off) when the reflective strips are detected on a residual core. Once the residual core has passed through the system for securing the hazardous area, the fourth reflective photoelectric cell 06 no longer receives any reflection of the light beam, and therefore the light beam barrier 03 is reactivated.

In the case of an automatic transport vehicle, the muting function can be implemented via two reflective photoelectric cells 06, since the automatic transport vehicle does not travel all the way through the light beam barrier, rather only a part of it enters the reel changer 02 in order to deliver the reel 05. The first reflective photoelectric cell 06 detects the reflective strip which is positioned on the vehicle in accordance with the arrangement of the reflective photoelectric cells 06, and switches the light beam barrier 03 off. When the second reflective photoelectric cell 06 no longer receives any reflection of the light beam during the removal of the automatic transport vehicle, the light beam barrier 03 is reactivated.

The two uppermost light beams 04 of the light beam barrier 03 remain permanently active, in order to prevent a person or an object accompanying the reel 05 or the residual core from entering the secured area in which reels are automatically loaded onto a reel changer 02 while the system for securing the hazardous area by means of the light beam barrier 03 is deactivated.

The second, permanently active, contactless safety device comprises at least two light beams 07, which extend transversely to the longitudinal extension or axial direction of the reel 05 and intersect a slight distance above the reel 05, with their continued extension passing close to the reel 05 or the reel core. The point of intersection of the two light beams 07 preferably lies only a few centimeters, for example, <15 cm, particularly <8 cm, preferably <5 cm, above the upper edge of the reel, and the light beams 07 then extend below the point of intersection at a distance of a few millimeters, for example, <15 mm, particularly <8 mm, preferably <5 mm up to a few centimeters, past the reel 05. The upper end points of the light beams 07 are therefore above the reel 05 but beyond the reel extension. The lower end points lie below the upper edge of the reel, preferably at a height that is greater than ½ the reel diameter and corresponds to approximately ⅔ to ¾ the reel diameter.

As is clear from FIG. 3*c*, the path of the two light beams 07 does not allow the light beams 07 to be unintentionally stepped over or unintentionally passed below. In any case, persons are able to pass below the light beams 07 only by moving in a severely bent position.

Figure 4:
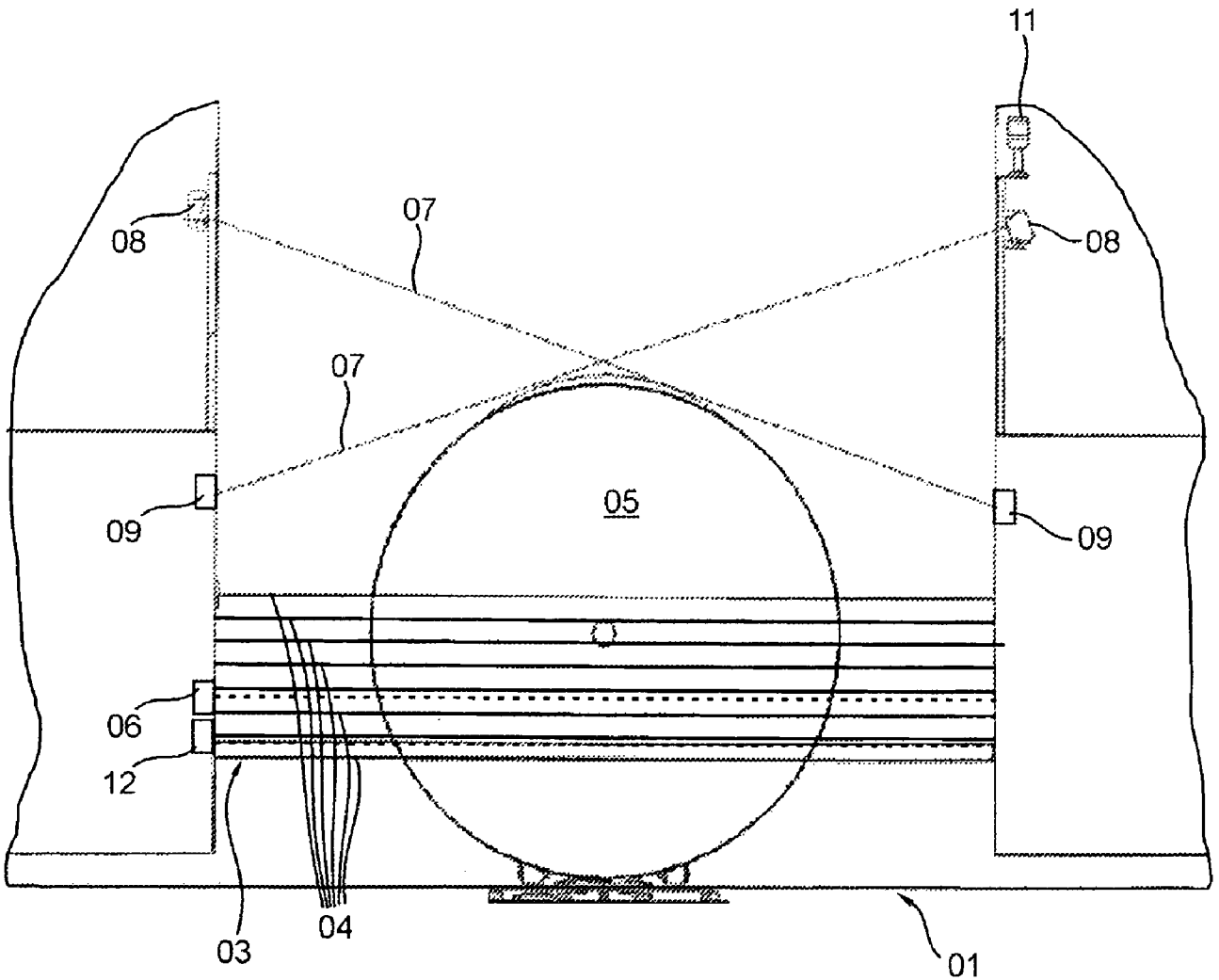
FIG. 4 a frontal view of an embodiment of the system for securing a hazardous area in the region surrounding the automatic loading of reels, with a photoelectric cell for positioning a reel in a starting position.

FIG. 4 shows a frontal view of an embodiment of the system for securing a hazardous area in the region 01 surrounding the automatic loading of reels. In the embodiment example shown, reflective fight beam interruption detectors are used. The second, permanently active, contactless safety device comprises a combined transmitting and receiving unit 08 for each light beam 07. The light beam 07 is reflected back to the transmitting and receiving unit 08 by an opposing reflector 09. This beam path can also be used with the light beams 04 of the light beam barrier 03. Of course, one-way beam interruption detectors, in which transmitter and receiver are arranged opposite one another, can also be used with the second, permanently active safety device and/or with the light beam barrier 03. In alternative embodiments, all the light beams 04; 07 of the light beam barrier 03 and the second, permanently active safety device can have precisely one transmitter and one receiver. In these cases, multiple deflecting mirrors are required for directing the light beams 04; 07. A light-emitting diode or laser diode that emits infrared radiation or visible light can be used as the transmitter, and a phototransistor can be used as the receiver.

It has proven advantageous for the position of the transmitting and receiving units 08 and of the reflectors 09 to be adjustable. For this purpose, it is expedient to equip the second, permanently active safety device with a sensor (not shown) for detecting the reel diameter. The sensor can, in turn, be connected to an adjustment device (not shown), which performs an automatic positioning of the transmitting and receiving units 08 and of the reflectors 09 on the basis of the detected reel diameter. In this manner, an optimal path of the light beams 07 can always be ensured. Of course, the position of transmitting and receiving units 08 and of the reflectors 09 can also be manually corrected. It has proven favorable for a suitable scale to be applied to the reel changer 02 for this purpose.

If a person or an object that is not allowed access enters the secured area in which reels are automatically loaded onto the reel changer 02, accompanying the reel 05 or the residual core, while the light beam barrier is deactivated, the person or the object that is not allowed access will interrupt the beam path of at least one of the light beams 07. This disruption will be detected by the receiver and converted to corresponding adjustment signals, which will cause the reel changer 02 to switch off. In addition, an alarm device 11 can send out an alarm in the form of a visible and/or acoustic signal.

The system for securing a hazardous area preferably further comprises four reflective photoelectric cells 06 for muting and one photoelectric cell 12, which is arranged inside the secured area in which reels are automatically loaded onto the reel changer 02, for positioning the reel 05 in a starting position, and which is connected to an evaluation unit, not shown here. The reel 05 coming from loading upstream passes through the system for securing the hazardous area and the detection area of the photoelectric cell 12 downstream. The evaluation unit detects the release of the photoelectric cell 12 and stops actuation of the reel. The reel 05 is transported backward toward the starting position by the reel drive, until the light beam of the photoelectric cell 12 is again interrupted.

In every case, the light beams can also be deflected, generated and/or received and/or deflected by separate transmitters and receivers, and optionally by mirrors, rather than by transmitting and receiving units and reflectors.

While a preferred embodiment of a device for securing a hazardous area in the region surrounding the automatic loading of reels on a reel changer, in accordance with the present invention, has been set forth fully and completely hereinabove, it will be apparent to one of skill in the art that various changes in, for example, the specific structures of the reel changers, the devices used to transport the reels to the reel changers, and the like, could be made without departing from the true spirit and scope of the subject invention which is to be limited only by the appended claims.

What is claimed is:

1. A system for securing a hazardous area in a region of reel transport to a reel changer, the system comprising:

a first contactless safety device at access boundaries of the region, which first contactless safety device can be deactivated to allow a known object to pass in and out of the hazardous area, and which first contactless safety device is embodied as a light beam barrier, which has multiple first light beams passing parallel to one another;

an evaluation unit, the evaluation unit including means to detect a sequence of interruption of the multiple first light beams when any object passes in and out of the hazardous area, and, on the basis of this sequence, to detect a known object that is allowed access to the hazardous area, and in which case to deactivate the first contactless safety device; and a second contactless safety device which is permanently active, the second contactless safety device including at least two second light beams which extend transversely to a longitudinal extension of the known object and which each pass parallel to, and spaced from imaginary tangents which are located on an upper half of the known object.

2. The system for securing a hazardous area according to claim 1, characterized in that the known object is one of a reel, a residual core, and an automatic transport vehicle.

3. The system for securing a hazardous area according to claim 1, characterized in that the first light beams are spaced uniformly from one another.

4. The system for securing a hazardous area according to claim 3, characterized in that the spacing is 40 mm.

5. The system for securing a hazardous area according to claim 1, characterized in that the first light beams extend horizontally.

6. The system for securing a hazardous area according to claim 5, characterized in that the surface of the light beam barrier is arranged inclined toward the vertical.

7. The system for securing a hazardous area according to claim 1, characterized in that the first light beams extend inclined toward horizontal.

8. The system for securing a hazardous area according to claim 6, characterized in that the angle of inclination is 15°.

9. The system for securing a hazardous area according to claim 1, characterized in that at least one first light beam of the light beam barrier and passing above the known object is permanently active.

10. The system for securing a hazardous area according to claim 1, characterized in that the system further comprises at least two photoelectric cells for deactivating the light beam barrier, and which are connected to the evaluation unit.

11. The system for securing a hazardous area according to claim 10, further wherein the at least two photoelectric cells are reflective photoelectric cells which are responsive to reflective strips on the known object.

12. The system for securing a hazardous area according to claim 10 wherein the known object is one of a residual core and a driverless, automatic transport vehicle.

13. The system for securing a hazardous area according to claim 10 wherein two first photoelectric cells are located before the light beam barrier in a direction of reel transport to the reel changer and two second photoelectric cells are located after the light beam barrier in the direction of reel transport.

14. The system for securing a hazardous area according to claim 1, characterized in that an upper end point of each of the second light beams lies above an upper edge of the known object.

15. The system for securing a hazardous area according to claim 1, characterized in that a respective lower end point of each of the second light beams lies below an upper edge of the known object.

16. The system for securing a hazardous area according to claim 1, characterized in that the second light beams intersect above the known object, with their continued path extending past the known object.

17. The system for securing a hazardous area according to claim 1, characterized in that a respective lower end points of each of the second light beams is arranged above the upper half of the known object.

18. The system for securing a hazardous area according to claim 1, characterized in that a transmitter and a receiver are assigned to each first and second light beam, and are positioned at the end points of each of the first and second light beams.

19. The system for securing a hazardous area according to claim 1, characterized in that each of the safety devices comprises precisely one transmitter, one receiver and multiple deflecting mirrors for all of the first and second light beams.

20. The system for securing a hazardous area according to claim 18, characterized in that transmitter and receiver for each light beam are arranged opposite one another.

21. The system for securing a hazardous area according to claim 18, characterized in that a combined transmitting and receiving unit is arranged opposite a reflector.

22. The system for securing a hazardous area according to claim 21, characterized in that the position of at least one of the transmitter, receiver and reflector can be adjusted.

23. The system for securing a hazardous area according to claim 1, characterized in that the first and second contactless safety devices each comprise a sensor for detecting the dimensions of the known object.

24. The system for securing a hazardous area according to claim 23, characterized in that the sensor is connected to an adjustment device, wherein the adjustment device serves to automatically adjust transmitter, at least one of a receiver, a reflector and a deflecting mirror on the basis of the known object.

25. The system for securing a hazardous area according to claim 1, characterized in that the known object is a reel having a diameter >450 mm.

26. The system for securing a hazardous area according to claim 1, characterized in that the system for securing a hazardous area includes a photoelectric cell, which is arranged inside the secured area and enables a positioning of one of a reel and an automatic transport vehicle in a starting position.

27. A system for securing a hazardous area in a region of reel transport to a reel changer, the system comprising:

a first contactless safety device at access boundaries of the region, which first contactless safety device can be deactivated to allow a known object to pass in and out of the hazardous area, and which first contactless safety device is embodied as a light beam barrier, which has multiple first light beams passing parallel to one another;

an evaluation unit, the evaluation unit including means to detect a sequence of interruption of the multiple first light beams when any object passes in and out of the hazardous area, and, on the basis of this sequence, to detect a known object that is allowed access to the hazardous area, and in which case to deactivate the first contactless safety device; and a second contactless safety device which is permanently active, the second contactless safety device including at least two second light beams which extend transversely to a longitudinal extension of the known object and wherein lower end points of each of the second light beams are arranged above a lower half of the known object.

28. A system for securing a hazardous area in a region of reel transport to a reel changer, the system comprising:

a first contactless safety device at access boundaries of the region, which first contactless safety device can be deactivated to allow a known object to pass in and/or out of the hazardous area, and which first contactless safety device is embodied as a light beam barrier, which has multiple first light beams passing parallel to one another;

an evaluation unit, the evaluation unit including means to detect a sequence of interruption of the multiple first light beams when any object passes in and/or out of the hazardous area, and, on the basis of this sequence, to detect a known object that is allowed access to the hazardous area, and in which case to deactivate the first contactless safety device;

a second contactless safety device which is permanently active;

a sensor adapted to detect dimensions of the known object; and an adjustment device connected to the sensor and usable to automatically adjust at least one of a transmitter, a receiver, a reflector and a deflecting mirror on the basis of the known object.

* * * * *